US011681245B2

(12) United States Patent
Kinoshita et al.

(10) Patent No.: US 11,681,245 B2
(45) Date of Patent: Jun. 20, 2023

(54) MOVABLE-MEMBER SUPPORTER WITH A FIRST GUIDE CONNECTED TO A SECOND GUIDE

(71) Applicant: FUJIFILM Business Innovation Corp., Tokyo (JP)

(72) Inventors: Shoya Kinoshita, Kanagawa (JP); Jun Noguchi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/406,201

(22) Filed: Aug. 19, 2021

(65) Prior Publication Data

US 2022/0373940 A1 Nov. 24, 2022

(30) Foreign Application Priority Data

May 21, 2021 (JP) ..... JP2021-086302

(51) Int. Cl.

| | |
|---|---|
| ***G03G 15/16*** | (2006.01) |
| ***B65H 37/04*** | (2006.01) |
| ***G03G 15/00*** | (2006.01) |
| ***G03G 21/18*** | (2006.01) |

(52) U.S. Cl.

CPC ..... *G03G 15/1605* (2013.01); *B65H 37/04* (2013.01); *G03G 15/165* (2013.01); *G03G 15/6541* (2013.01); *G03G 15/6544* (2013.01); *G03G 15/6573* (2013.01); *G03G 15/6582* (2013.01); *G03G 21/1821* (2013.01); *G03G 21/1842* (2013.01)

(58) Field of Classification Search

CPC ..... G03G 15/1605; G03G 15/165; G03G 15/6541; G03G 15/6544; G03G 15/6573; G03G 15/6582; G03G 21/1821; G03G 21/1842; B65H 37/04

See application file for complete search history.

(56) References Cited

U.S. PATENT DOCUMENTS

2019/0291496 A1* 9/2019 Noguchi ..... B65H 29/12

FOREIGN PATENT DOCUMENTS

JP 2020-40738 A 3/2020

* cited by examiner

*Primary Examiner* — Joseph S Wong
(74) *Attorney, Agent, or Firm* — Oliff PLC

(57) ABSTRACT

A movable-member supporter includes: a first support member that includes a first support plate, a first guide unit provided at the first support plate, and a first connection section, the first guide unit guiding movement of a movable member and having one end that extends to one side surface of the first support plate, the first connection section being provided at the one side surface of the first support plate; and a second support member that includes a second support plate, a second guide unit provided at the second support plate, and a second connection section, the second guide unit guiding movement of the movable member and having one end that extends to one side surface of the second support plate, the second connection section being provided at the one side surface of the second support plate and being connected with the first connection section of the first support member.

13 Claims, 10 Drawing Sheets

MOVABLE-MEMBER SUPPORTER WITH A FIRST GUIDE CONNECTED TO A SECOND GUIDE

CROSS-REFERENCE TO RELATED APPLICATIONS

This application is based on and claims priority under 35 USC 119 from Japanese Patent Application No. 2021-086302 filed May 21, 2021.

BACKGROUND

(i) Technical Field

The present disclosure relates to movable-member supporters, post-processing apparatuses, and image forming systems.

(ii) Related Art

Japanese Unexamined Patent Application Publication No. 2020-040738 discloses a post-processing apparatus and an image forming system. The post-processing apparatus is configured to perform a binding process on a recording medium in accordance with a binding command and includes a first binding unit, a second binding unit, and a controller. The first binding unit is movable along a movement path and performs a first binding process. The second binding unit is movable along a movement path and performs a second binding process. The controller controls the movement of the first binding unit and the movement of the second binding unit.

SUMMARY

Aspects of non-limiting embodiments of the present disclosure relate to a movable-member supporter, a post-processing apparatus, and an image forming system that may share a first support member between multiple apparatuses with different movable-member guide ranges.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a movable-member supporter including: a first support member that includes a first support plate, a first guide unit provided at the first support plate, and a first connection section, the first guide unit guiding movement of a movable member and having one end that extends to one side surface of the first support plate, the first connection section being provided at the one side surface of the first support plate; and a second support member that includes a second support plate, a second guide unit provided at the second support plate, and a second connection section, the second guide unit guiding movement of the movable member and having one end that extends to one side surface of the second support plate, the second connection section being provided at the one side surface of the second support plate and being connected with the first connection section of the first support member, wherein the first guide unit and the second guide unit are continuously connected via the one side surface of the first support plate and the one side surface of the second support plate.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described below with reference to the drawings. The following description schematically indicates an appropriate range for achieving the exemplary embodiments of the present disclosure. Thus, the appropriate range for explaining the exemplary embodiments of the present disclosure will be basically described, whereas sections without explanations will be based on known technologies.

First Exemplary Embodiment

Figure 1:
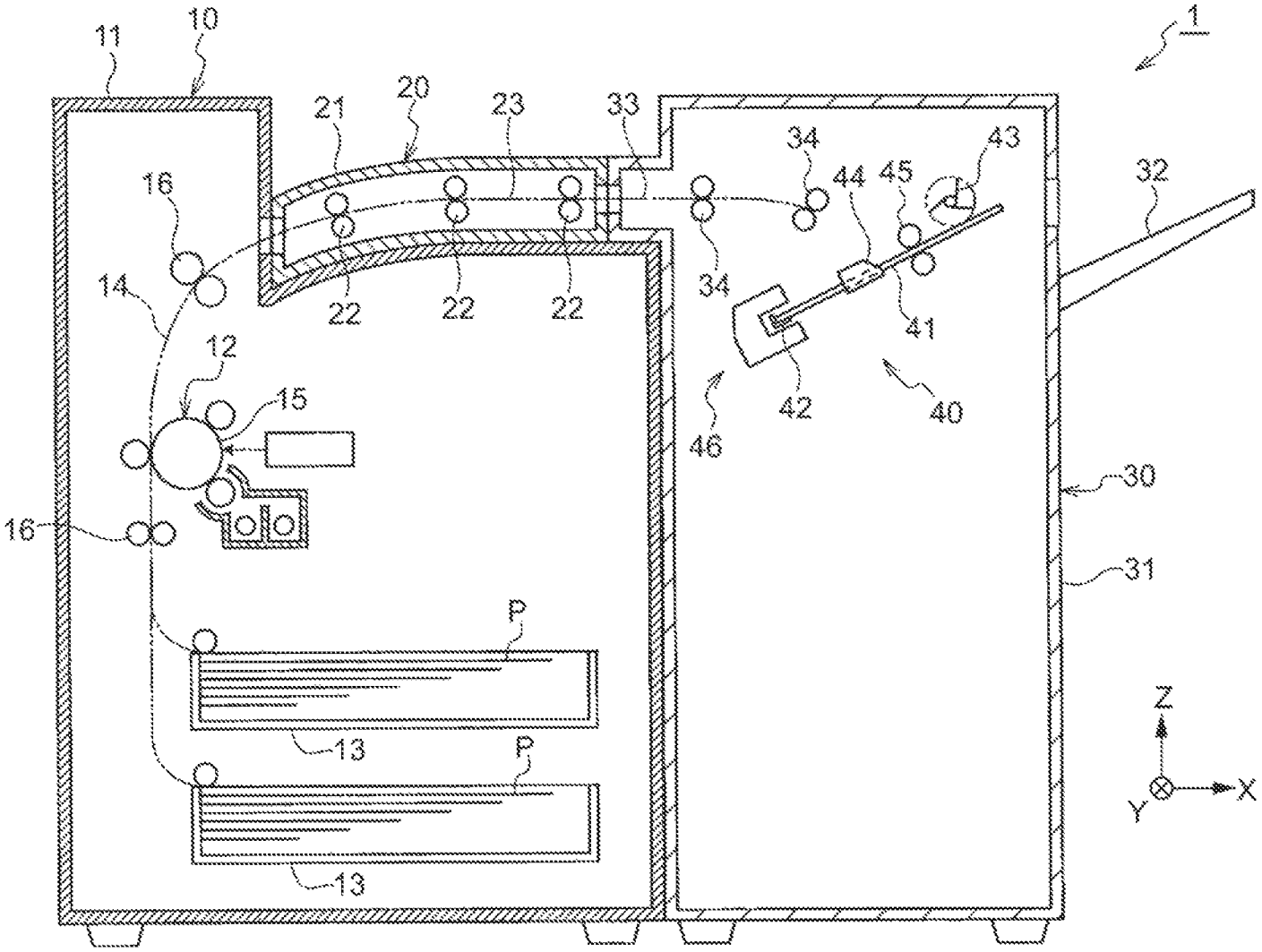
FIG. 1 schematically illustrates an example of an image forming system according to a first exemplary embodiment of the present disclosure.

FIG. 1 schematically illustrates an example of an image forming system 1 according to a first exemplary embodiment of the present disclosure. The image forming system 1 according to this exemplary embodiment may include an image forming unit 10, a transport unit 20, and a post-processing unit 30. In the following description, it is assumed that the X direction shown in FIG. 1 is defined as the lateral direction, the Y direction is defined as the depth direction, and the Z direction is defined as the height direction. The image forming unit 10 is an example of an image forming unit, and the post-processing unit 30 is an example of a post-processing apparatus.

The image forming unit 10 may include an image-forming-unit body 11. The image-forming-unit body 11 may contain an image forming section 12 and two sheet containers 13. The image-forming-unit body 11 may also be provided with a transport path 14 therein.

The image forming section 12 is provided for forming an image onto a sheet P as an example of a recording medium. The image forming section 12 may form the image onto the sheet P by using an electrophotographic method that involves forming the image by transferring a toner image preliminarily adhered to a photoconductor drum 15 onto the sheet P. The image forming method used by the image forming section 12 is not limited to the aforementioned electrophotographic method and may alternatively be, for example, an inkjet method that involves forming the image by ejecting ink onto the sheet P. Normally, the sheet P is paper, but may alternatively be, for example, another type of printable medium, such as a film-like medium.

The two sheet containers 13 contain sheets P of various sizes and various types in a stacked fashion. The sheets P contained in each sheet container 13 are fed one-by-one to the image forming section 12. The number of sheet containers 13 is not limited to two, and may be one or three or more.

The transport path 14 is provided for transporting the sheet P to a desired location in the image forming unit 10, and is configured to transport the sheet P fed from the sheet container 13 and having the image formed thereon at the image forming section 12 and discharge the sheet P outside the image-forming-unit body 11. Multiple transport rollers 16 are disposed at appropriate locations along this transport path 14.

The transport unit 20 has a transport-unit body 21. The transport-unit body 21 has multiple transport rollers 22 disposed therein. The transport unit 20 is disposed to connect a sheet outlet of the image forming unit 10 and a sheet inlet of the post-processing unit 30. The transport unit 20 is provided with a transport path 23 therein for transporting the sheet P discharged from the image forming unit 10 into a post-processing-unit body 31. The transport unit 20 may alternatively have a hole punching device (not shown) disposed therein for punching one or more holes in the sheet P.

The post-processing unit 30 has the post-processing-unit body 31. The post-processing-unit body 31 has a binding unit 40 disposed therein. The binding unit 40 is a device that binds sheets P together and is configured to form a sheet bundle PB (see FIG. 5) by binding multiple sheets P together. The post-processing-unit body 31 has attached thereto a discharge section 32 to which the sheet P or the sheet bundle PB bound together by the binding unit 40 is to be discharged. The post-processing-unit body 31 also has therein a transport path 33 including multiple transport rollers 34. The transport path 33 transports the sheet P transported into the post-processing-unit body 31 toward the binding unit 40.

The binding unit 40 may include a stacking plate 41, a stopper 42, a paddle 43, a tamper 44, a discharge roller 45, and a binding device 46. The stacking plate 41 may be a plate-like member on which the sheet P transported from the transport path 33 is stackable. The stacking plate 41 may allow multiple sheets P to be stacked on the upper surface thereof by being inclined at any angle (e.g., about 30°) such that the stopper-42-side end of the stacking plate 41 is positioned lower in the height direction than the opposite end thereof. The stopper 42 is provided for positionally aligning multiple sheets P in the transport direction by bringing the trailing edge of the multiple sheets P in the transport direction thereof into abutment with the stopper 42. The paddle 43 is provided above the stacking plate 41 and pushes each sheet P toward the stopper 42 by rotating in response to a driving force received from a driving source (not shown). The tamper 44 is movable in a direction (referred to as "width direction of the sheet P" hereinafter) extending parallel to the depth direction and crosswise relative to the transport direction of multiple sheets P, and aligns the widthwise positions of the multiple sheets P (i.e., the sheet bundle PB) by sandwiching the sheets P from the opposite widthwise sides thereof. The discharge roller 45 operates to discharge the sheet bundle PB, after undergoing the binding process by the binding device 46 to be described later, to the discharge section 32.

Figure 2:
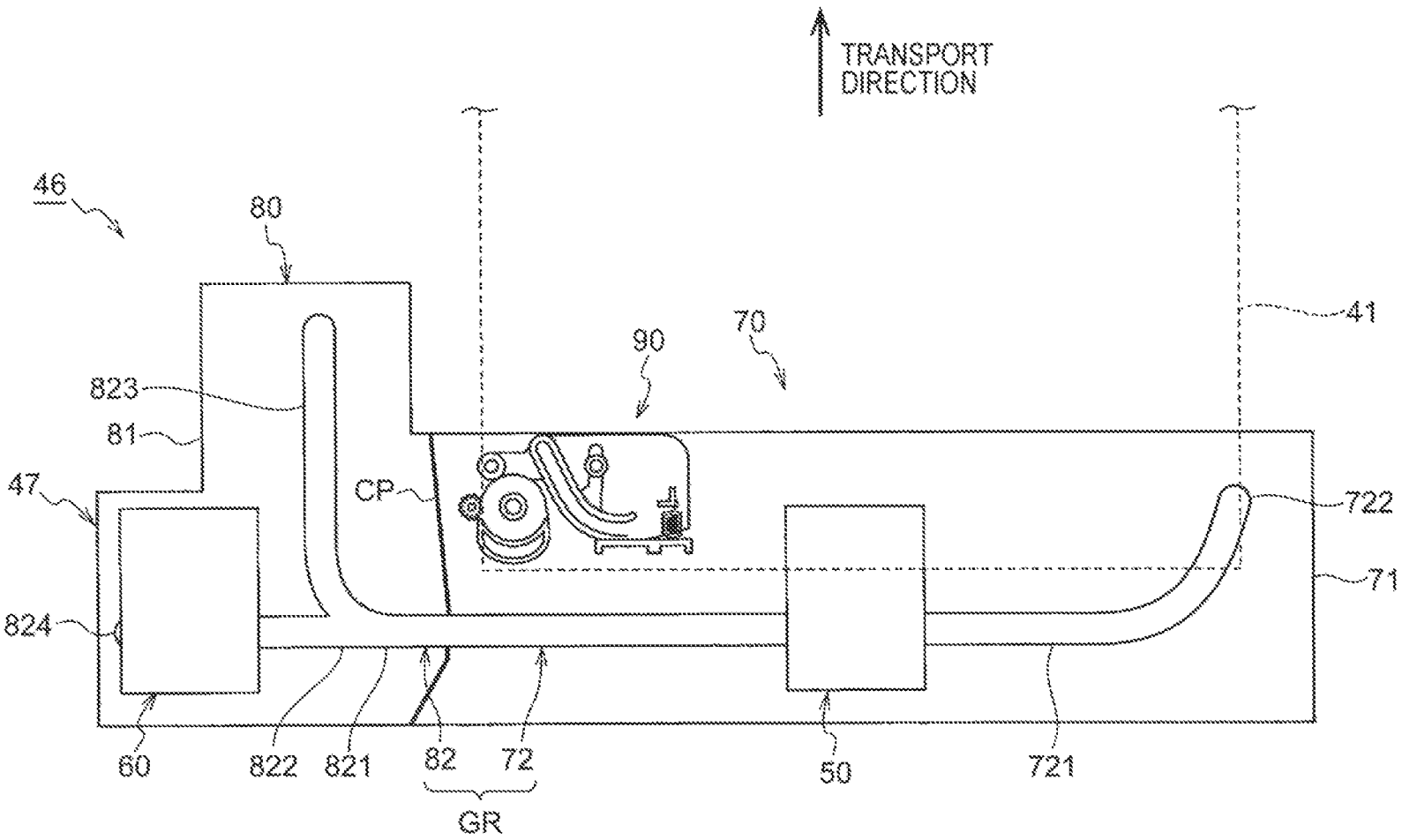
FIG. 2 is a plan view schematically illustrating a binding unit of the image forming system shown in FIG. 1.

FIG. 2 is a plan view schematically illustrating the binding unit 40 of the image forming system 1 shown in FIG. 1. As shown in FIG. 2, the binding device 46 of the binding unit 40 according to this exemplary embodiment is capable of executing multiple types of binding processes, as an example of first post-processing and second post-processing, on one or more locations of the stopper-42-side edge of multiple sheets P (i.e., sheet bundle PB) stacked on the stacking plate 41. In order to achieve this, the binding device 46 according to this exemplary embodiment includes a configuration in which a staple binding member 50 that binds multiple sheets P together by using staples and a staple-less binding member 60 that binds sheets P together without using staples are supported by a first movable-member supporter 47. The first movable-member supporter 47 is provided with a long-hole-like guide rail GR that guides the movement of the staple binding member 50 and the movement of the staple-less binding member 60. The staple binding member 50 is an example of a first movable member or a movable member, and the staple-less binding member 60 is an example of a second movable member or a movable member.

Figure 3:
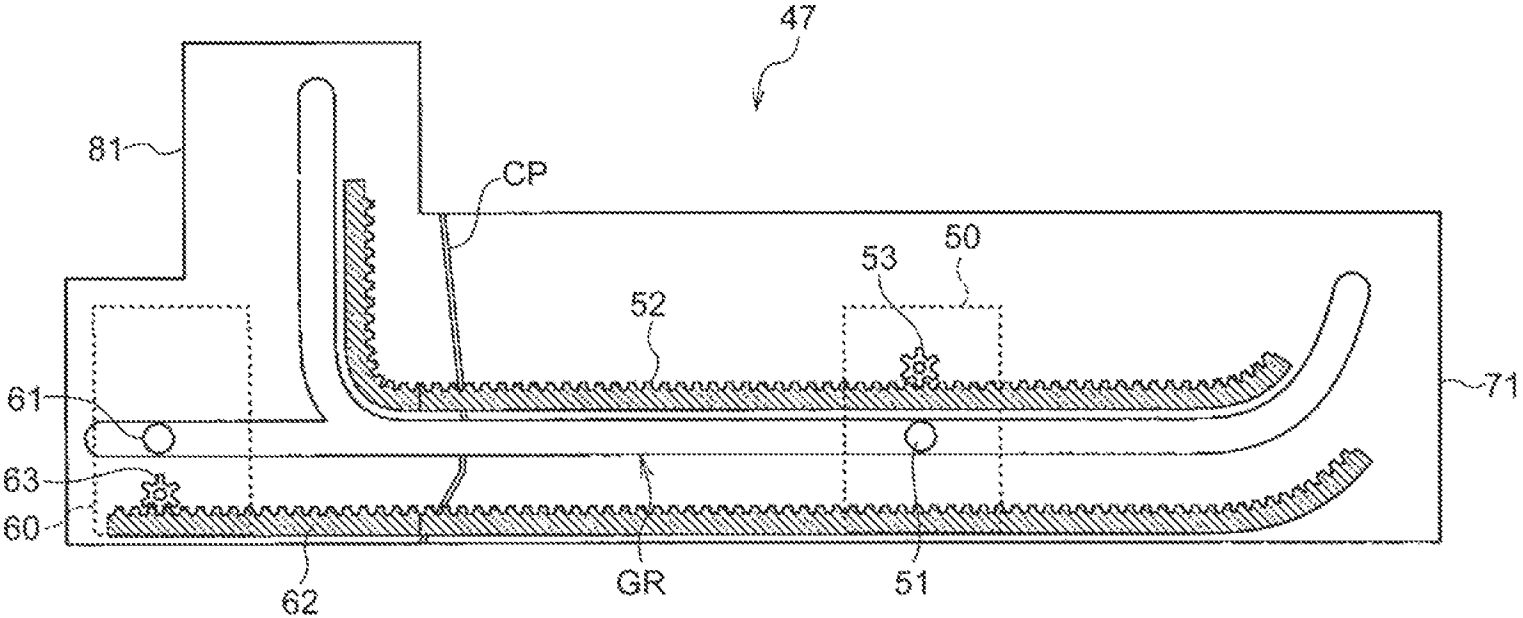
FIG. 3 schematically illustrates a movement structure of each of a staple binding member and a staple-less binding member in the binding unit shown in FIG. 2.
Figure 4:
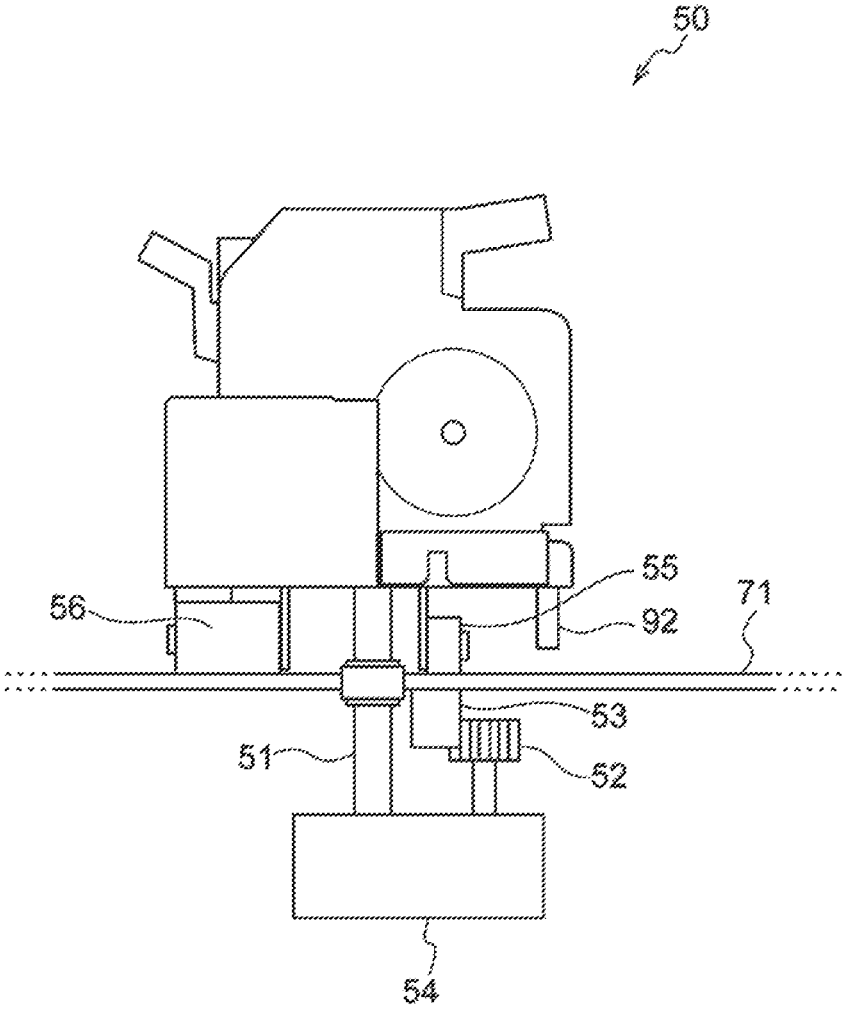
FIG. 4 is a side view illustrating a relevant part of the staple binding member in the binding unit shown in FIG. 2.

FIG. 3 schematically illustrates the movement structure of each of the staple binding member 50 and the staple-less binding member 60 in the binding unit 40 shown in FIG. 2, and shows first and second support plates 71 and 81 in a perspective view for illustrating the rear structure of the first and second support plates 71 and 81. FIG. 4 is a side view illustrating a relevant part of the staple binding member 50 in the binding unit 40 shown in FIG. 2. As shown in FIGS. 2 to 4, the first movable-member supporter 47 of the binding device 46 according to this exemplary embodiment includes first and second support members 70 and 80 that are joined together at a joint CP. The first support member 70 at least includes a first support plate 71 extending in the width direction of the sheet P (or the sheet bundle PB) and a first guide path 72 serving as a part of the guide rail GR that guides the movement of the staple binding member 50 and the movement of the staple-less binding member 60. The second support member 80 at least includes a substantially inverted-T-shaped second support plate 81 extending in the width direction of the sheet P and protruding in the transport direction of the sheet P from an intermediate position thereof, and a second guide path 82 serving as a part of the guide rail GR.

The first guide path 72 may include a first principal guide path 721 extending in the width direction of the sheet P and a bent path 722 extending in a bent fashion in the transport direction of the sheet P from the front end (i.e., the right end in FIG. 2) of the first principal guide path 721 in the depth direction. The rear end (i.e., the left end in FIG. 2) of the first principal guide path 721 in the depth direction is continuously connected with the second guide path 82 via the joint CP.

The second guide path 82 may include a second principal guide path 821 extending in the width direction of the sheet P, a bifurcation path 822 that is provided at the rear end of the second principal guide path 821 in the depth direction and that bifurcates the guide rail GR into two paths, a staple-binding-member retraction path 823 extending in the transport direction of the sheet P from the bifurcation path 822, and a staple-less-binding-member retraction path 824 extending in the width direction of the sheet P from the bifurcation path 822. The front end of the first principal guide path 721 in the depth direction is continuously connected with the first guide path 72 via the joint CP.

The staple binding member 50 moves along a path defined by the bent path 722, the first principal guide path 721, the second principal guide path 821, the bifurcation path 822, and the staple-binding-member retraction path 823 of the guide rail GR. As specifically shown in FIGS. 3 and 4, in order to realize this movement, the staple binding member 50 includes a staple-binding-member insertion pin 51, a staple-binding-member rack 52, a staple-binding-member pinion 53, a staple-binding-member driver 54, staple-binding-member inner wheels 55, and staple-binding-member outer wheels 56.

The staple-binding-member insertion pin 51 is inserted into the guide rail GR to guide the staple binding member 50 in the moving direction thereof. The staple-binding-member rack 52 is constituted of a rack gear provided along the movement path of the staple binding member 50 at the rear side of the first and second support plates 71 and 81. The staple-binding-member pinion 53 is constituted of a pinion gear that engages with the staple-binding-member rack 52. The staple-binding-member driver 54 includes a driving source, such as a motor, and is fixed to the staple-binding-member insertion pin 51 and supplies a driving force to the staple-binding-member pinion 53. The staple-binding-member inner wheels 55 are secured to the lower surface of the staple binding member 50 in such a manner that the staple-binding-member inner wheels 55 are rotatable one or more times, such as twice. The staple-binding-member inner wheels 55 support the staple binding member 50 while rolling along an inner position (in the transport direction) of the guide rail GR on the upper surface of the first and second support plates 71 and 81. The staple-binding-member outer wheels 56 are secured to the lower surface of the staple binding member 50 in such a manner that the staple-binding-member outer wheels 56 are rotatable one or more times, such as twice. The staple-binding-member outer wheels 56 support the staple binding member 50 while rolling along an outer position (i.e., the opposite side from the inner position in the transport direction) of the guide rail GR on the upper surface of the first and second support plates 71 and 81. The staple binding member 50 actuates the staple-binding-member driver 54 to rotate the staple-binding-member pinion 53, thereby causing the staple-binding-member inner wheels 55 and the staple-binding-member outer wheels 56 to roll along the staple-binding-member rack 52.

The staple-less binding member 60 moves along a movement path defined by the bent path 722, the first principal guide path 721, the second principal guide path 821, the bifurcation path 822, and the staple-less-binding-member retraction path 824 of the guide rail GR. The staple-less binding member 60 moves along the aforementioned movement path by having a driving structure similar to that of the staple binding member 50. Specifically, the staple-less binding member 60 may include a staple-less-binding-member insertion pin 61, a staple-less-binding-member rack 62, a staple-less-binding-member pinion 63, a staple-less-binding-member driver (not shown), staple-less-binding-member inner wheels 65 (see FIG. 7), and staple-less-binding-member outer wheels 66 (see FIG. 7). Since these components are identical to those of the staple binding member 50, descriptions thereof will be omitted. The above-described structures for moving the staple binding member 50 and the staple-less binding member 60 are not limited to those described above so long as the binding members are movable along the guide rail GR, and may be changed to different structures.

Figure 5:
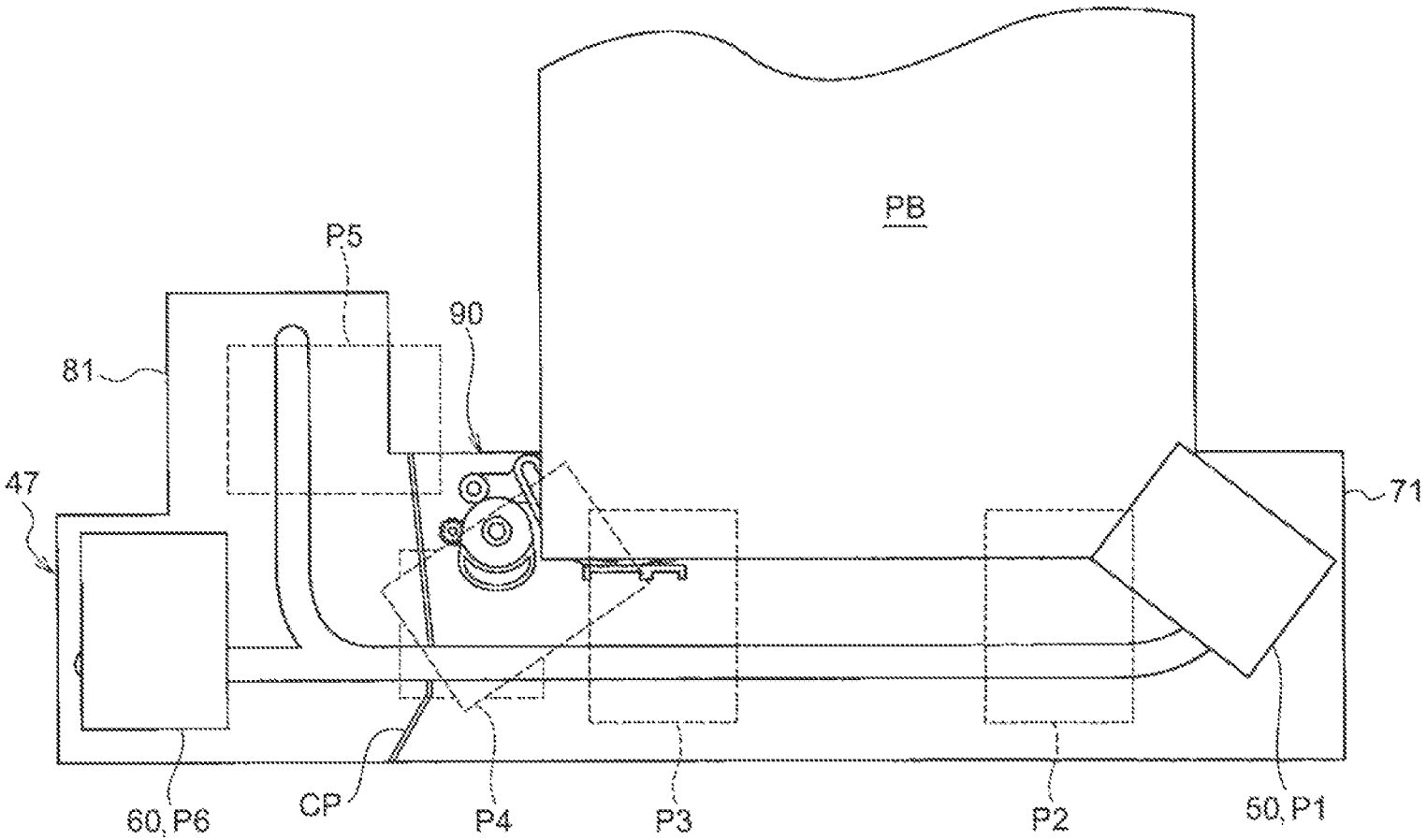
FIG. 5 illustrates binding positions of a binding device in the binding unit shown in FIG. 2.

FIG. 5 illustrates binding positions of the binding device 46 in the binding unit 40 shown in FIG. 2. As shown in FIG. 5, each of the staple binding member 50 and the staple-less binding member 60 moves along the guide rail GR so as to move between multiple binding positions and a retraction position. The multiple binding positions include a first binding position P1 for diagonally binding a right corner of the sheet bundle PB, second and third binding positions P2 and P3 for side-binding two locations at one edge of the sheet bundle PB that comes into abutment with the stopper 42, and a fourth binding position P4 for diagonally binding a left corner of the sheet bundle PB. The retraction position includes a staple-binding-member retraction position P5 where the staple binding member 50 is to be positioned when the staple-less binding member 60 operates or when the binding device 46 is stopped, and also includes a staple-less-binding-member retraction position P6 where the staple-less binding member 60 is to be positioned when the staple binding member 50 operates or when the binding device 46 is stopped. The staple binding member 50 is movable among the first binding position P1, the second and third binding positions P2 and P3, the fourth binding position P4, and the staple-binding-member retraction position P5 described above. The staple-less binding member 60 is movable among the first binding position P1, the second and third binding positions P2 and P3, the fourth binding position P4, and the staple-less-binding-member retraction position P6. The two retraction positions P5 and P6 described above are each located where the movement path of a first one of the binding members during operation thereof is not interfered by a second one of the binding members when the second binding member is positioned at the corresponding retraction position, so that the second binding member does not hinder the movement of the first binding member. The first binding position P1 is located at the front side of the image forming system 1 in the depth direction. Therefore, when a maintenance process is to be performed on the staple binding member 50 and the staple-less binding member 60 or when a staple refilling process is to be performed on the staple binding member 50, the relevant binding member may be positioned at the first binding position P1, thereby achieving improved workability for maintenance.

It should particularly be noted that the first to fourth binding positions P1 to P4 shown in FIG. 5 are all disposed within the first support member 70. With the aforementioned four binding positions P1 to P4 being contained within the first support member 70 in this manner, the binding device 46 is capable of performing appropriate binding operation in the first support member 70, whereby a binding process may be executed regardless of the shape of the second support member 80. Accordingly, the shape that the second support member 80 may have has a high degree of freedom. The structure of the first movable-member supporter 47 will be described below in further detail with reference to FIGS. 6A and 6B.

Figure 6A:
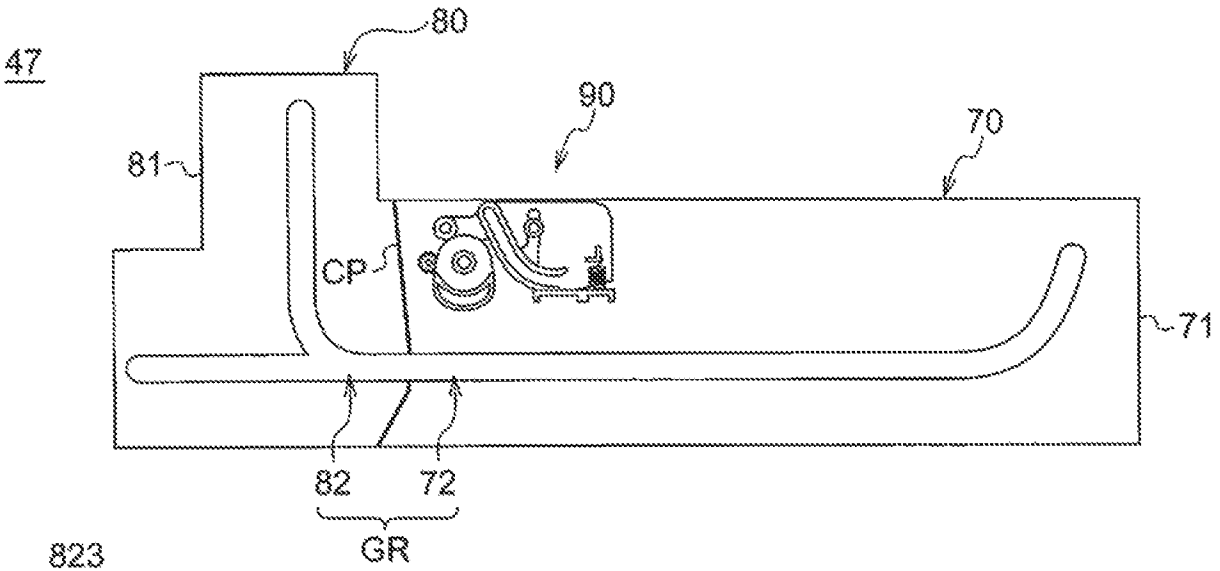
FIGS. 6A and 6B are plan views schematically illustrating an example of a movable-member supporter according to the first exemplary embodiment of the present disclosure.
Figure 6B:
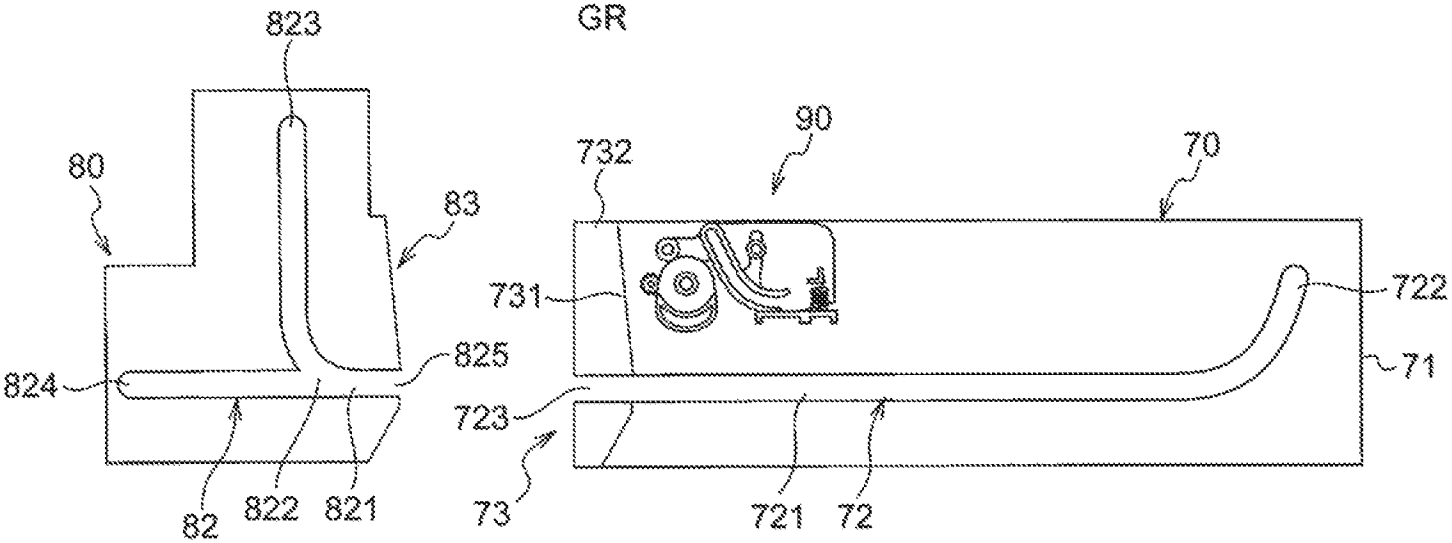

FIGS. 6A and 6B are plan views schematically illustrating an example of the movable-member supporter 47 according to the first exemplary embodiment of the present disclosure. Specifically, FIG. 6A illustrates the first support member 70 and the second support member 80 in a joined state, and FIG. 6B illustrates the first support member 70 and the second support member 80 in a separated state. As shown in FIG. 6A, the first movable-member supporter 47 according to this exemplary embodiment includes a single continuous guide rail GR that includes a path bifurcated into two paths at an intermediate point. On the other hand, as shown in FIG. 6B, the first movable-member supporter 47 is constituted by joining the first support member 70 and the second support member 80 serving as different components. Therefore, the guide rail GR is also formed by joining the first guide path 72 of the first support member 70 and the second guide path 82 of the second support member 80.

In order to join the first support member 70 and the second support member 80, one side surface of the first support plate 71 at the rear side in the depth direction is provided with a first connection section 73. One side surface of the second support plate 81 at the front side in the depth direction is provided with a second connection section 83 having a shape adjusted to be connectable to the first connection section 73. The first connection section 73 may include a connection surface 731 to be brought into abutment with the second connection section 83, to be described later, and a step 732 that extends toward the second support member 80 from the connection surface 731 and that is to be positioned adjacent to the lower surface of the second connection section 83 when the first and second connection sections 73 and 83 are connected. A specific structure employed for connecting the first connection section 73 and the second connection section 83 may be a known connection structure. For example, an engagement structure for engaging the connection sections 73 and 83 with each other may be employed, the step 732 of the first connection section 73 and the second connection section 83 may be secured to each other by using one or more screws, or a lock structure for maintaining the connection sections 73 and 83 in a connected state may be employed.

In the first principal guide path 721 of the first support member 70, the end opposite from the end having the bent path 722 extends to one side surface of the first support plate 71 that is provided with the first connection section 73, thereby forming a joint section 723 for joining the first guide path 72 to the second guide path 82. In the second principal guide path 821 of the second support member 80, the end opposite from the end having the bifurcation path 822 extends to one side surface of the second support plate 81 that is provided with the second connection section 83, thereby forming a joint section 825 for joining the second guide path 82 to the first guide path 72. The aforementioned two joint sections 723 and 825 are preliminarily positioned such that the two joint sections 723 and 825 are continuously connected with each other when the first connection section 73 and the second connection section 83 are connected. Accordingly, when the first connection section 73 and the second connection section 83 are connected, the first guide path 72 and the second guide path 82 are continuously connected with each other via the one side surface of the first support plate 71 provided with the first connection section 73 and the one side surface of the second support plate 81 provided with the second connection section 83. Moreover, the guide rail GR extending continuously through the first support member 70 and the second support member 80 is formed in the first movable-member supporter 47.

In order to reduce the size of the first support member 70, the connection surface 731 of the first connection section 73 may extend in a direction orthogonal to the extending direction of the first principal guide path 721 at a position where an appropriate length of the first principal guide path 721 is ensured. However, the joint CP defined by the connection surface 731 and the end surface of the second connection section 83 forms a groove-like recess in the upper surface of the first movable-member supporter 47 due to a gap formed between the connection surface 731 and the end surface of the second connection section 83 when the first and second connection sections 73 and 83 are connected. Thus, if the connection surface 731 of the first connection section 73 is to be formed as described above, the groove-like recess formed by the joint CP may also extend in the direction orthogonal to the extending direction of the first principal guide path 721. On the other hand, as described above, the staple binding member 50 and the staple-less binding member 60 move by using multiple wheels (i.e., the staple-binding-member inner wheels 55, the staple-binding-member outer wheels 56, the staple-less-binding-member inner wheels 65, and the staple-less-binding-member outer wheels 66) that roll on the first support plate 71 and the second support plate 81. Because the rotation axes of these wheels extend in a direction orthogonal to the moving direction, the ground contact face of each wheel constantly extends in a direction orthogonal to the extending direction of the guide rail GR. Specifically, if the connection surface 731 extends in the direction orthogonal to the extending direction of the first principal guide path 721, as described above, the extending direction of the groove-like recess formed by the joint CP and the extending direction of the ground contact face of each of the wheels of the staple binding member 50 and the staple-less binding member 60 may undesirably be aligned with each other. This is problematic in that the wheels of the staple binding member 50 and the staple-less binding member 60 may fall into and become caught in the groove-like recess formed by the joint CP.

Figure 7:
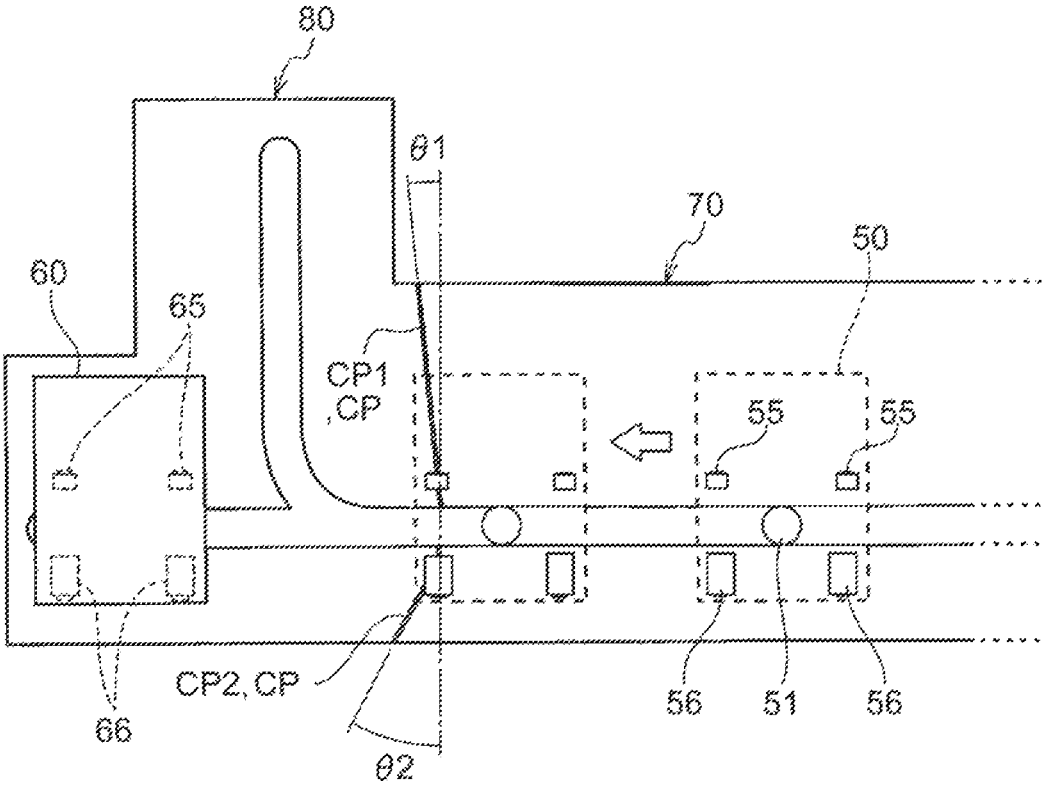
FIG. 7 schematically illustrates a state where the staple binding member is passing through a joint.

FIG. 7 schematically illustrates a state where the staple binding member 50 is passing through the joint CP. As shown in FIGS. 6A to 7, in the first movable-member supporter 47 according to this exemplary embodiment, the connection surface 731 of the first connection section 73 and the end surface of the second connection section 83 extend at an angle relative to the moving direction of the staple binding member 50 and the staple-less binding member 60 in view of the aforementioned point. With such a configuration, the extending direction of the groove-like recess formed by the joint CP and the extending direction of the ground contact face of each of the wheels of the staple binding member 50 and the staple-less binding member 60 may be prevented from being aligned with each other, as shown in FIG. 7. Specifically, for example, as compared with a configuration in which one side surface of each of the support members constituting the joint CP extends in the direction orthogonal to the moving direction of the staple binding member 50 and the staple-less binding member 60, each of the wheels of the staple binding member 50 and the staple-less binding member 60 may be less likely to become caught in the joint CP. With regard to the extending direction of the groove-like recess formed by the joint CP and the extending direction of the ground contact face of each wheel, the advantage of preventing the wheel from being caught in the joint CP may be achieved to a certain extent so long as the two extending directions are at least partially not aligned with each other. Thus, for example, a part of the joint CP shown in FIG. 7 where each staple-binding-member outer wheel 56 is to pass may partially extend in the direction orthogonal to the extending direction of the first principal guide path 721.

An inclination angle of each of the connection surface 731 of the first connection section 73 and the end surface of the second connection section 83 relative to the moving direction of the staple binding member 50 and the staple-less binding member 60 may be adjusted to various angles. As shown in FIGS. 6A to 7, in this exemplary embodiment, the inclination angles are adjusted such that a shape protruding toward the first support member 70 with a freely-chosen point of the first guide path 72 serving as an apex in plan view is obtained. Specifically, a segment of the joint CP located forward in the transport direction relative to the first guide path 72 (this segment may be referred to as "first joint segment CP1" hereinafter) is inclined at a freely-chosen angle θ1 in the counterclockwise direction with reference to the rotation axis of each staple-binding-member inner wheel 55 that is to roll on the relevant section. On the other hand, a segment of the joint CP located opposite from the transport direction relative to the first guide path 72 (this segment may be referred to as "second joint segment CP2" hereinafter) is inclined at a freely-chosen angle θ2 in the clockwise direction with reference to the rotation axis of each staple-binding-member outer wheel 56 that is to roll on the relevant section. Although each of the aforementioned inclination angles is adjustable, where appropriate, an excessively small angle may make it difficult to achieve the advantage of preventing each wheel from being caught in the joint CP, whereas an excessively large angle may lead to an unnecessary increase in size of the first movable-member supporter 47. Therefore, it is desirable that the angles θ1 and θ2 be adjusted within a range between, for example, 5° and 45°. As an alternative to this exemplary embodiment in which a large part of the joint CP is inclined relative to the moving direction of the staple binding member 50 and the staple-less binding member 60, the aforementioned advantage may be achieved so long as at least a part where the wheels of the staple binding member 50 and the staple-less binding member 60 are to pass is inclined. However, in view of the ease of machinability of the connection surface 731 of the first connection section 73 and the end surface of the second connection section 83, the joint CP may be inclined over the entire length thereof, as in this exemplary embodiment.

With the joint CP having the shape protruding toward the first support member 70 with a freely-chosen point of the first guide path 72 serving as an apex in plan view, there is another advantage in which the first support member 70 may be reduced in size. Specifically, for example, assuming that the joint CP has a shape protruding toward the second support member 80 with a freely-chosen point of the first guide path 72 serving as an apex in plan view, the first principal guide path 721 may have an unnecessarily large length, resulting in an increase in size of the first support member 70. In contrast, with the shape according to this exemplary embodiment, the joint CP may be inclined while the first principal guide path 721 has a minimum length, whereby the first support member 70 may be reduced in size. Needless to say, the aforementioned configuration in which the joint CP has the shape protruding toward the second support member 80 with a freely-chosen point of the first guide path 72 serving as an apex in plan view is included as an exemplary embodiment of the present disclosure. Likewise, in the first movable-member supporter 47 according to this exemplary embodiment of the present disclosure, the first joint segment CP1 and the second joint segment CP2 may be inclined in the same direction or at the same angle.

As mentioned above, the first principal guide path 721 of the first support member 70 extends linearly to the joint section 723 so as to form the joint section 723 at one end of the first principal guide path 721. On the other hand, as mentioned above, the fourth binding position P4 where the staple binding member 50 and the staple-less binding member 60 are to diagonally bind the left corner of the sheet bundle PB is provided at a location adjacent to this joint section 723. The first movable-member supporter 47 according to this exemplary embodiment further includes a rotation mechanism 90 for rotating the staple binding member 50 and the staple-less binding member 60 diagonally relative to the guide rail GR at the fourth binding position P4 without bending the first guide path 72.

Figure 8A:
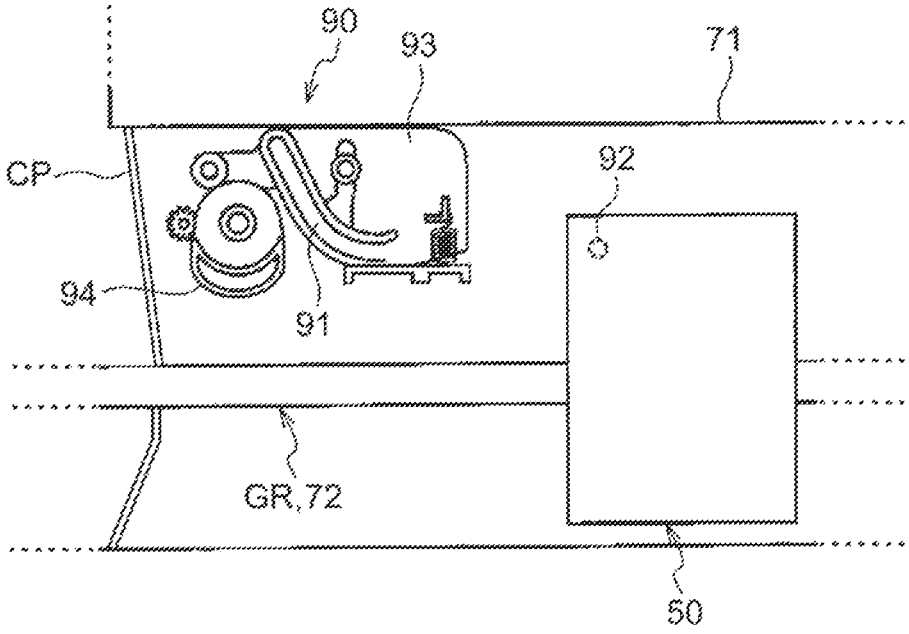
FIGS. 8A and 8B illustrate a rotation mechanism of the binding unit shown in FIG. 2.
Figure 8B:
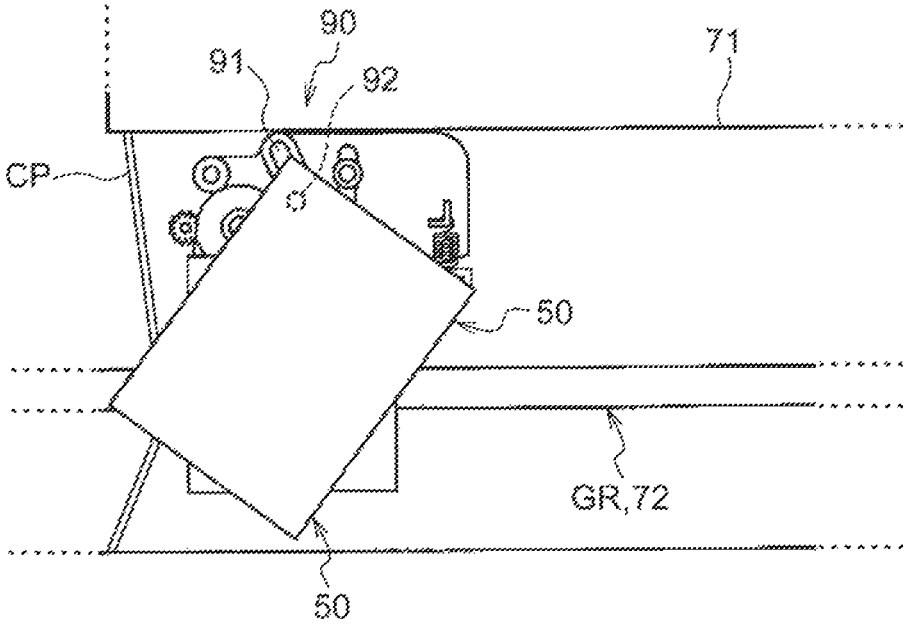

FIGS. 8A and 8B illustrate the rotation mechanism 90 for rotating the staple binding member 50 and the staple-less binding member 60. Specifically, FIG. 8A is an enlarged view of a relevant part illustrating a state before the staple binding member 50 is rotated by the rotation mechanism 90, and FIG. 8B is an enlarged view of a relevant part illustrating a state where the staple binding member 50 has been rotated by the rotation mechanism 90. As shown in FIGS. 8A and 8B, the rotation mechanism 90 of the first movable-member supporter 47 according to this exemplary embodiment may at least include a guide groove 91, a guide pin 92, a rotating table 93, and a cam 94. The guide groove 91 is an example of a limiting unit, and the guide pin 92 is an example of a guide.

The guide groove 91 is constituted of a wall surface standing upright from the rotating table 93 and having a first end with an opening extending in the depth direction and a second closed end that extends while bending in the transport direction. When the guide pin 92 enters this guide groove 91 through the opening at the first end, the guide groove 91 comes into contact with the guide pin 92 so as to limit the movement thereof. The guide pin 92 is attached to the bottom surface of each of the staple binding member 50 and the staple-less binding member 60 at a position where the guide pin 92 is capable of entering the opening of the guide groove 91 when the staple binding member 50 or the staple-less binding member 60 is to move from the bent path 722 toward the bifurcation path 822. The rotating table 93 is a base whose one end is rotatably supported by the first support plate 71. By rotating the rotating table 93, the guide groove 91 provided in the upper surface of the rotating table 93 is movable. The rotating table 93 is biased toward the adjacent guide rail GR by a coil spring, so that the opening of the guide groove 91 is positioned on the movement path of the guide pin 92. The cam 94 is disposed in a rotatable manner at a location adjacent to the rotating table 93 and rotates in accordance with a driving force from a driving source (not shown), thereby rotating the rotating table 93.

The rotating operation of the rotation mechanism 90 having the above-described configuration will now be described. First, as shown in FIG. 8A, when the staple binding member 50 or the staple-less binding member 60 moves along the guide rail GR from the bent path 722 toward the bifurcation path 822, the guide pin 92 attached to the staple binding member 50 or the staple-less binding member 60 moving in this manner enters the opening at the first end of the guide groove 91. Thus, the guide groove 91 limits the movement of the guide pin 92 entering the guide groove 91 in the depth direction in a stepwise fashion, and guides the guide pin 92 and the staple binding member 50 or the staple-less binding member 60 having the guide pin 92 attached thereto to move in the transport direction. Accordingly, the staple binding member 50 or the staple-less binding member 60 is rotated along with the movement of the guide pin 92 to an angle where diagonal binding of the sheet bundle PB is possible at the fourth binding position P4.

If the staple binding member 50 and the staple-less binding member 60 are not to be rotated at the fourth binding position P4, the rotating table 93 is rotated in the transport direction by moving the cam 94. Accordingly, the opening of the guide groove 91 moves away from the movement path of the guide pin 92, so that the staple binding member 50 and the staple-less binding member 60 may travel without rotating at the fourth binding position P4.

According to the rotation mechanism 90 described above, the staple binding member 50 and the staple-less binding member 60 are rotatable at a location adjacent to the first connection section 73 without having to bend the first-connection-section-73-side end of the first guide path 72. Then, the left and right diagonal binding and the side-binding are executable in the first support member 70. Accordingly, the first support member 70 may be reduced in size, as compared with a case where the staple binding member 50 and the staple-less binding member 60 are rotated based on, for example, a method of bending the guide rail GR. In the first movable-member supporter 47 according to this exemplary embodiment, the second guide path 82 in the second support member 80 may be continuously connected with the first guide path 72 with a simple structure. In addition, the binding operation at each of the multiple binding positions P1 to P4 may be realized by the first support member 70 alone, so that a binding position does not have to be provided in the second support member 80. Moreover, two components, namely, the guide pin 92 and the guide groove 91, are used as a rotating unit, so that the staple binding member 50 and the staple-less binding member 60 are rotatable with a simple configuration.

As described above, the movable-member supporter according to this exemplary embodiment is a supporter that allows two movable members to move by connecting two support members individually having connection sections. Therefore, the configuration of one of the support members may be simplified in line with the functions demanded in a post-processing apparatus and image forming system having such a movable-member supporter, thereby allowing for an extension of a guide unit. Accordingly, a movable-member supporter, post-processing apparatus, and image forming system with high extensibility may be provided.

As an alternative to the first exemplary embodiment described above in which the staple binding member 50 and the staple-less binding member 60 are used as first and second movable members, a change to other movable members or an addition of another movable member is also possible. For example, various modifications are possible, such as employing multiple staple binding members with different types of staples in place of the staple-less binding member 60 or further employing a post-processing apparatus that performs punching. Moreover, as an alternative to the first exemplary embodiment described above in which the four binding positions P1 to P4 are disposed in the first support member 70 and the binding operation is executable only in the first support member 70, the binding operation may be executed in the second support member 80.

In addition, in a case where the number of movable members, the size thereof, or the location of the binding operation is to be changed, as described above, it is also desirable that the shape of the second support member 80 be changed. Since it is not necessary to provide a binding position in the second support member 80 in the first movable-member supporter 47 according to this exemplary embodiment, the shape of the second support member 80 is changeable relatively freely. In detail, for example, the second guide path 82 of the second support member 80 may be bifurcated into three or more paths at the bifurcation path 822, may have a bifurcation-less path structure, or may be a partially bent path.

In the first movable-member supporter 47 according to the first exemplary embodiment described above, two support members, namely, the first support member 70 and the second support member 80, are connected with each other. The second support member 80 described here is basically employed for forming a retraction path to be used for causing the two movable members, namely, the staple binding member 50 and the staple-less binding member 60, to move without interfering with each other in the first movable-member supporter 47. Therefore, if a movable-member supporter is to guide a single movable member, appropriate binding operation may be realized without causing the movable member to move along the second guide path 82 in the aforementioned second support member 80. The following description relates to a second exemplary embodiment of the present disclosure in which a second movable-member supporter 47A serves as a movable-member supporter for when guiding a single movable member.

Second Exemplary Embodiment

Figure 9:
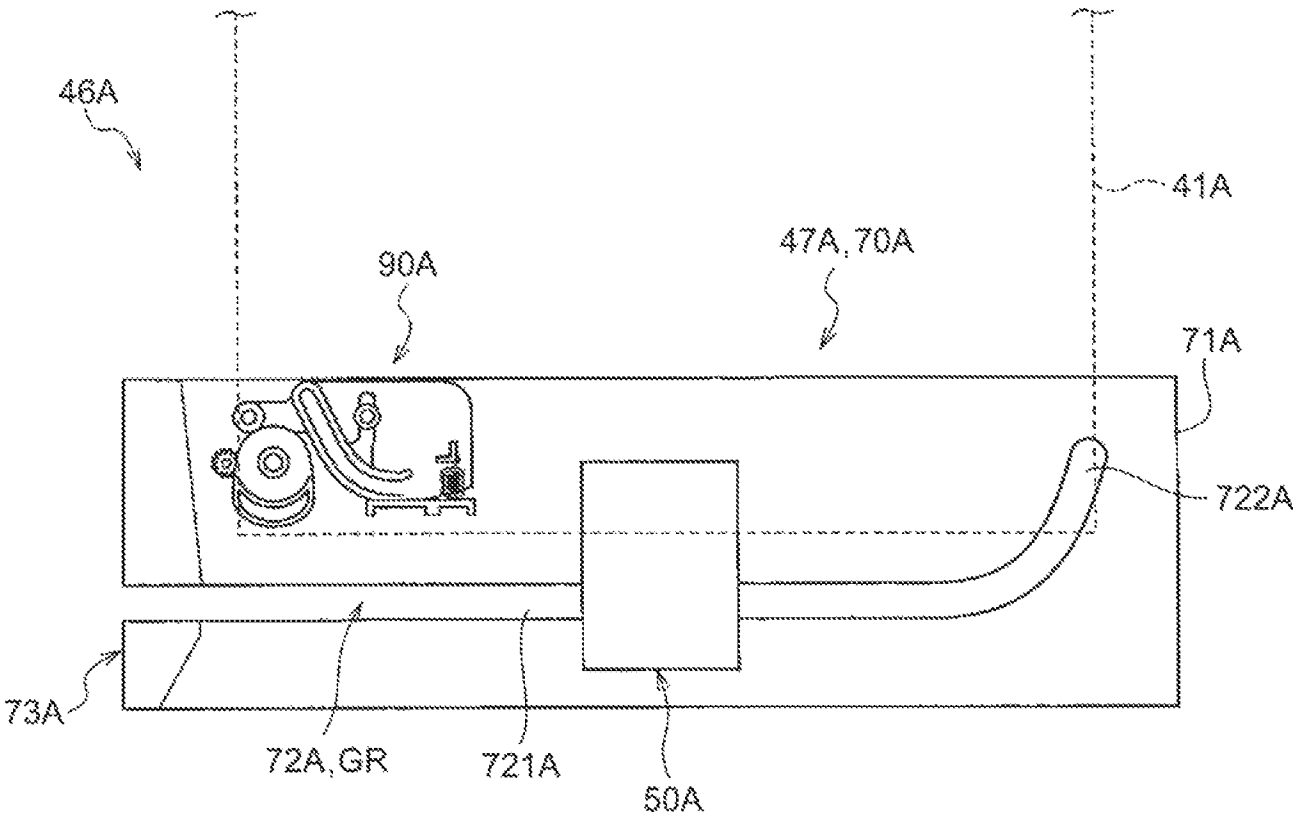
FIG. 9 is a plan view schematically illustrating a binding unit of an image forming system according to a second exemplary embodiment of the present disclosure.
Figure 10:
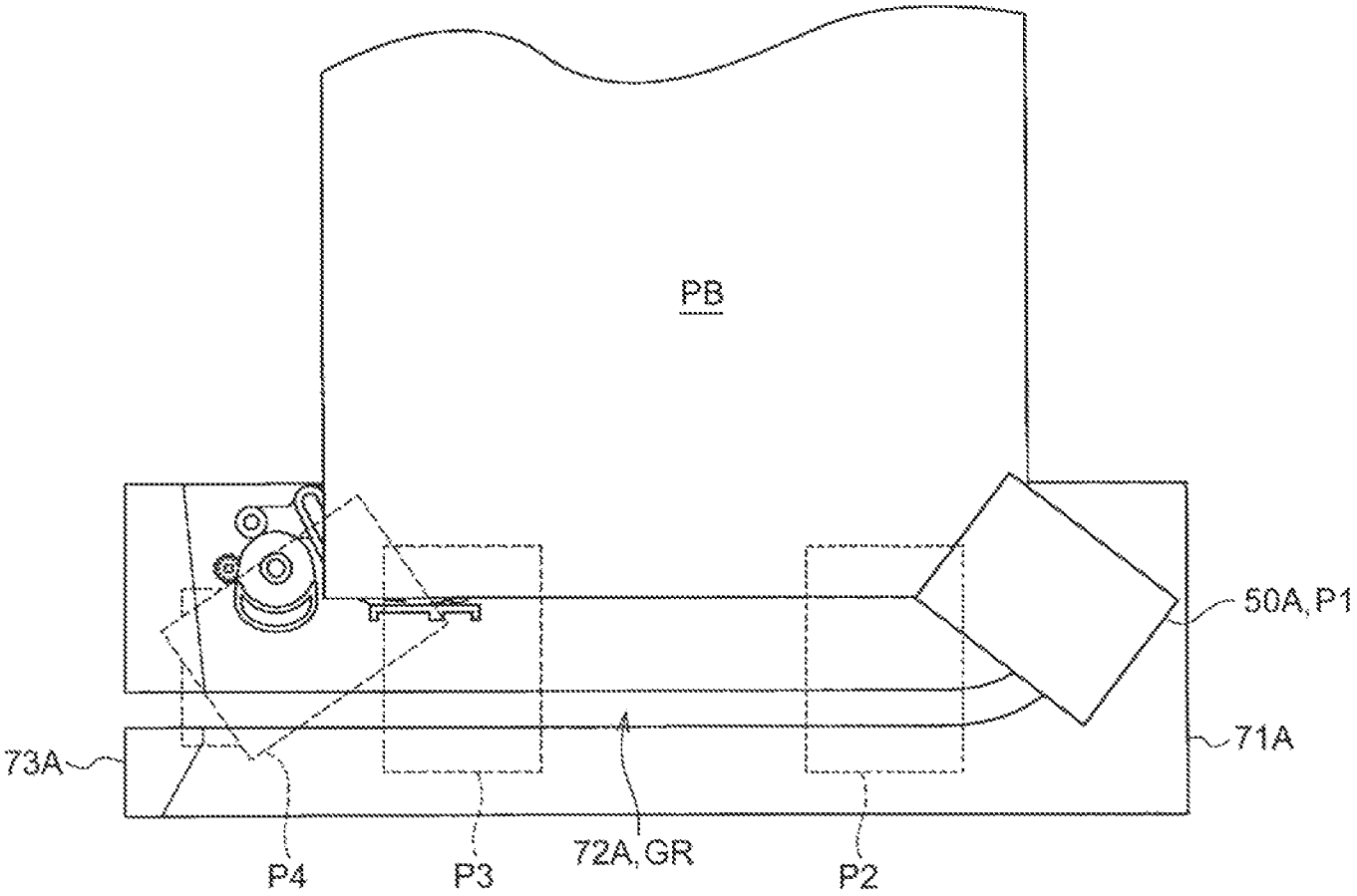
FIG. 10 illustrates binding positions of a binding device in the binding unit shown in FIG. 9.

FIG. 9 is a plan view schematically illustrating a binding unit of an image forming system according to a second exemplary embodiment of the present disclosure. FIG. 10 illustrates binding positions of a binding device in the binding unit shown in FIG. 9. The second movable-member supporter 47A, the post-processing apparatus, and the image forming system according to this exemplary embodiment share the configuration with the first movable-member supporter 47, the post-processing apparatus, and the image forming system according to the first exemplary embodiment, respectively, except for a part of the second movable-member supporter 47A. Therefore, in FIGS. 9 and 10, components identical to those of the first movable-member supporter 47, the post-processing apparatus, and the image forming system according to the first exemplary embodiment described above are given the same reference signs with an addition of a suffix "A", and detailed descriptions thereof will be omitted. The following description focuses on differences from the first exemplary embodiment.

A binding device 46A of the binding unit as an example of the post-processing apparatus according to this exemplary embodiment may include the second movable-member supporter 47A and a staple binding member 50A as an example of a movable member. As shown in FIGS. 9 and 10, the second movable-member supporter 47A is constituted of a first support member 70A having a configuration similar to that of the first support member 70 according to the first exemplary embodiment described above. The first support member 70A at least includes a first support plate 71A extending in the width direction of the sheet P, a first guide path 72A serving as the guide rail GR, and a first connection section 73A provided at one side surface of the first support plate 71A.

Of the aforementioned components, the first guide path 72A may include a first principal guide path 721A extending in the width direction of the sheet P and a bent path 722A extending in a bent fashion in the transport direction of the sheet P from the front end (i.e., the right end in FIG. 9) of the first principal guide path 721A in the depth direction. In addition, the rear end (i.e., the left end in FIG. 9) of the first principal guide path 721A in the depth direction extends to the first connection section 73A and has an opening at the first connection section 73A so that when the first connection section 73A is connected with another support member, the rear end is continuously connectable to a guide path of the relevant support member. Furthermore, for example, the first connection section 73A is also provided for connecting to another support member, such as the aforementioned second support member 80, and has a fixation structure (not shown).

It is clear from the above description that the first support member 70A included in the second movable-member supporter 47A according to this exemplary embodiment has a structure identical to that of the first support member 70 of the first movable-member supporter 47 according to the first exemplary embodiment. Specifically, in a movable-member supporter constituting a post-processing apparatus that includes a single movable member alone, as in the binding unit according to this exemplary embodiment, the movable-member supporter according to the first exemplary embodiment may be partially employed.

The staple binding member 50A attached to the second movable-member supporter 47A according to this exemplary embodiment is capable of executing a binding process on a sheet bundle at binding positions equal in number to those in the first exemplary embodiment described above. In detail, as shown in FIG. 10, the binding operation may be executed at four binding positions, namely, the first binding position P1 for diagonally binding the right side of the sheet bundle PB, the second and third binding positions P2 and P3 for side-binding the sheet bundle PB, and the fourth binding position P4 for diagonally binding the left side of the sheet bundle PB. Since there is only a single movable member, that is, the staple binding member 50A, attached to the second movable-member supporter 47A, the movable member does not have to be retracted. Therefore, the home position of the staple binding member 50A may be, for example, the first binding position P1.

As described above, the movable-member supporters according to the exemplary embodiments of the present disclosure may partially share a support member (i.e., the first support member) between the movable-member supporter that includes multiple movable members and the movable-member supporter that includes a single movable member. Furthermore, because the support member according to this exemplary embodiment is connectable to and disconnectable from another support member, an appropriate support member alone may be selectively used in conformity to the appropriate function of the post-processing apparatus. Accordingly, the movable-member supporter does not include a wasteful component disposed outside the movement range of the movable member, whereby the movable-member supporter may be manufactured with a smaller number of components and be reduced in size.

The exemplary embodiments of the present disclosure are not limited to those described above, and various modifications are permissible so long as they do not depart from the gist of the exemplary embodiments of the present disclosure. These modifications are to be included in the technical scope of the exemplary embodiments of the present disclosure.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A movable-member supporter comprising:

a first support that includes a first support plate, a first guide at the first support plate, and a first connection, the first guide guiding movement of a movable member and having one end that extends to one side surface of the first support plate, the first connection being at the one side surface of the first support plate; and a second support that includes a second support plate, a second guide at the second support plate, and a second connection, the second guide guiding movement of the movable member and having one end that extends to one side surface of the second support plate, the second connection being at the one side surface of the second support plate and being connected with the first connection of the first support, wherein the first guide and the second guide are discontinuous but connected via the one side surface of the first support plate overlapping with the one side surface of the second support plate.

2. The movable-member supporter according to claim 1, wherein the first connection and the second connection extend in a direction that is inclined relative to a moving direction of the movable member.

3. The movable-member supporter according to claim 2, wherein the one side surface of the first connection has a shape protruding toward the first support and having an apex defined by the first guide when the one side surface is viewed from a direction orthogonal to the first support plate.

4. The movable-member supporter according to claim 1, further comprising:

a rotating unit that is at a location adjacent to the first guide and that rotates the movable member along with the movement of the movable member, the movable member being moved while being guided by the first guide.

5. The movable-member supporter according to claim 2, further comprising:

a rotating unit that is at a location adjacent to the first guide and that rotates the movable member along with the movement of the movable member, the movable member being moved while being guided by the first guide.

6. The movable-member supporter according to claim 3, further comprising:

a rotating unit that is at a location adjacent to the first guide and that rotates the movable member along with the movement of the movable member, the movable member being moved while being guided by the first guide.

7. The movable-member supporter according to claim 4, wherein the rotating unit includes a guide pin in the movable member and a groove at the first support plate and that limits movement of the guide pin by coming into contact with the guide pin, and wherein the guide pin comes into contact with the groove along with the movement of the movable member so that the movable member rotates to become inclined relative to a direction of the movement.

8. The movable-member supporter according to claim 5, wherein the rotating unit includes a guide pin at the movable member and a groove at the first support plate and that limits movement of the guide pin by coming into contact with the guide pin, and wherein the guide pin comes into contact with the groove along with the movement of the movable member so that the movable member rotates to become inclined relative to a direction of the movement.

9. The movable-member supporter according to claim 6, wherein the rotating unit includes a guide pin in the movable member and a groove at the first support plate and that limits movement of the guide pin by coming into contact with the guide pin, and wherein the guide pin comes into contact with the groove along with the movement of the movable member so that the movable member rotates to become inclined relative to a direction of the movement.

10. A movable-member supporter comprising:

a support plate;

a guide pin at the support plate and that guides movement of a movable member, the guide pin having one end that extends to one side surface of the support plate; and a connection at the one side surface of the support plate and that is configured to connect with another discontinuous support plate capable of supporting the movable member by overlapping with the other support plate.

11. A post-processing apparatus comprising:

the movable-member supporter according to claim 1, wherein the movable member includes a first movable member and a second movable member, the first movable member being configured to perform first post-processing on a recording medium, the second movable member being configured to perform second post-processing different from the first post-processing on the recording medium.

12. A post-processing apparatus comprising:

the movable-member supporter according to claim 10, wherein the movable member is configured to perform post-processing on a recording medium.

13. An image forming system comprising:

an image forming unit that transports a recording medium and forms an image onto the recording medium; and the post-processing apparatus according to claim 11 downstream of the image forming unit in a transport direction of the recording medium.

* * * * *